US006225270B1

(12) United States Patent
Hennen et al.

(10) Patent No.: US 6,225,270 B1
(45) **Date of Patent: *May 1, 2001**

(54) SHAPED SOAP PRODUCTS CONTAINING ALKYL OLIGAGLYCASIDES AND TALCUM

(75) Inventors: Udo Hennen; Wolfhard Scholz; Werner Schneider, all of Krefeld (DE)

(73) Assignee: Henkel Kommanditgesellschaft auf Aktien, Duesseldorf (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/319,193

(22) PCT Filed: Nov. 24, 1997

(86) PCT No.: PCT/EP97/06557

§ 371 Date: Jun. 2, 1999

§ 102(e) Date: Jun. 2, 1999

(87) PCT Pub. No.: WO98/24872

PCT Pub. Date: Jun. 11, 1998

(30) Foreign Application Priority Data

Dec. 2, 1996 (DE) ..... 196 49 896

(51) Int. Cl.[7] ..... C11D 1/68; C11D 1/74; C11D 3/22

(52) U.S. Cl. ..... 510/151; 510/152; 510/195; 510/156; 510/470

(58) Field of Search ..... 510/130, 141, 510/152, 155, 156, 151, 470

(56) References Cited

U.S. PATENT DOCUMENTS

| | | | |
|---|---|---|---|
| 5,262,079 | 11/1993 | Kacher et al. | 252/112 |
| 5,340,492 | 8/1994 | Kacher et al. | 252/112 |
| 5,374,716 | 12/1994 | Biermann et al. | 536/18.6 |
| 5,705,462 | 1/1998 | Hormes et al. | 510/141 |
| 5,712,235 | 1/1998 | Nieendnick et al. | 510/151 |

FOREIGN PATENT DOCUMENTS

| | | |
|---|---|---|
| 593 422 | 2/1934 | (DE) . |
| 43 31 297 | 3/1995 | (DE) . |
| 43 37 031 | 5/1995 | (DE) . |
| 0 301 298 | 2/1989 | (EP) . |
| 0 463 912 | 1/1992 | (EP) . |
| WO97/03977 | 4/1990 | (WO) . |
| WO96/03487 | 2/1996 | (WO) . |

OTHER PUBLICATIONS

The Modern Soap and Detergent Industry, vol. 1 (1959) p. I.,III., 33. and p. 223.

*Primary Examiner*—Necholus Ogden
(74) *Attorney, Agent, or Firm*—Wayne C. Jaeschke; Glenn E. J. Murphy; Kimberly R. Hild

(57) ABSTRACT

A shaped soap composition is presented having 60 to 85 percent of an alkali metal soap of linear $C_{12-22}$ fatty acid, 1 to 10 percent alkyl oligoglycoside and 5 to 20 percent talcum. The shaped soap as a smooth surface and exhibits improved washing properties and lime soap dispersion power.

11 Claims, No Drawings

SHAPED SOAP PRODUCTS CONTAINING ALKYL OLIGAGLYCASIDES AND TALCUM

This application is filed under 35 U.S.C. 371 and based on PCT/EP97/06557, filed Nov. 24, 1997.

BACKGROUND OF THE INVENTION

1. Field of the Invention

This invention relates to shaped soap products, for example bar soaps, with improved smoothness and increased lime soap dispersion power through the presence of alkyl (oligo)glycosides and talcum.

2. Discussion of Related Art

It is known that the performance properties of toilet soaps based on tallow fatty acid and cocofatty acid can be modified and improved by numerous additives.

For example, it is known from DE-PS 593 422 that washing power and lime soap dispersion can be improved by addition of 10 to 15% by weight of cetyl maltoside. In addition, EP 0 463 912 A1, DE 43 31 297 A1 and DE 43 37 031 C2 describe soap bars based on fatty acid base soaps containing alkyl (oligo)glucosides. Although inorganic fillers are described as extenders for soaps in modern handbooks, for example Geoffrey Martin: The Modern Soap and Detergent Industry, Vol. 1, (1959), Chapter VI, talcum has more of an adverse effect in bar soaps.

Contrary to the adverse effects expected from the prior art, it has surprisingly been found that a further improvement in the physical and performance properties of bar soaps already containing alkyl glycosides, more especially their washing power and lime soap dispersion power and their smoothness, can be obtained by an addition of talcum.

DESCRIPTION OF THE INVENTION

Accordingly, the present invention relates to a shaped soap product containing 60 to 85% by weight of fatty acids containing 12 to 22 carbon atoms in the form of their alkali metal soaps and 1 to 10% by weight of alkyl (oligo)glycosides with the formula $R^1O—(G)_x$, where $R^1$ is a primary $C_{12-16}$ alkyl group and $(G)_x$ is an oligoglycoside unit with a degree of oligomerization x of 1 to 2, and, to improve its washing properties and lime soap dispersion power, 5 to 20% by weight of talcum.

In addition, the shaped soap products according to the invention have a particularly smooth surface after mechanical deformation. In use, they produce a creamy stable foam. The lime soap deposit formed in hard water remains dispersed in the water and does not lead to the greasy grey films on the surface of sanitary fittings.

In the context of the present invention, talcum is understood to be a hydrated magnesium silicate with the theoretical composition $3MgO.4SiO_2.\ H_2O$ or $Mg_3(Si_4O_{10}).(OH)_2$ although it may also contain quantities of hydrated magnesium aluminium silicate of up to 12% by weight $Al_2O_3$, based on the product as a whole.

The particle diameter (equivalent spherical diameter) of the talcum should be in the range from 0.5 to 50 $\mu$m. Talcum qualities containing no more than 5% by weight of particles smaller than 1 $\mu$m and no more than 5% by weight of particles larger than 50 $\mu$m in size have generally proved to be suitable. The percentage of particles larger than 40 $\mu$m in diameter (sieve residue) is at most 2% by weight. The mean particle diameter (D 50) is preferably from 5 to 15 $\mu$m.

The content of impurities should make up no more than 1.6% by weight $Fe_2O_3$, 1% by weight CaO and 1% by weight of unbound water (drying loss at 105° C.). The content of hydrated magnesium aluminium silicate may be up to 60% by weight, expressed as $Al_2O_3$, up to 12% by weight.

Suitable fatty acids for producing the base soap are linear fatty acids containing 12 to 22 carbon atoms, for example lauric acid, myristic acid, palmitic acid, stearic acid, arachic acid and behenic acid, and unsaturated fatty acids, for example palmitoleic acid, oleic acid, linoleic acid, linolenic acid, arachidonic acid and erucic acid. The technical mixtures obtainable from vegetable and animal fats and oils, for example cocofatty acid and tallow fatty acid, are preferably used. Mixtures of coco- and tallow fatty acid cuts, more especially a mixture of 50 to 80% by weight $C_{16-18}$ tallow fatty acid and 20 to 50% by weight $C_{12-14}$ cocofatty acid, are particularly preferred.

The fatty acids are used in the form of their alkali metal soap, normally as sodium soaps. However, the soaps may also be directly produced from the fats and oils by saponification (hydrolysis) with sodium hydroxide and removal of the glycerol. The shaped soap products according to the invention preferably contain an additional 1 to 10% by weight of free fatty acids containing 12 to 22 carbon atoms. These free fatty acids may be identical with those of the base soap and may be introduced into the base soap through a corresponding deficit of alkali metal during the saponification. However, the free fatty acids are preferably introduced after the saponification step and after concentration, but before drying.

Alkyl (oligo)glycosides are known commercially available nonionic surfactants which may be obtained by relevant methods or organic chemistry and which correspond to the formula1 $R^1—O(G)_x$, where $R^1$ is a primary $C_{12-16}$ alkyl group and $(G)_x$ is an oligoglycoside unit with a degree of oligomerization x of 1 to 2. EP-A-0 301 298 and WO-A-90/3977 are cited as representative of the extensive literature available on the subject. The alkyl (oligo)glycosides may be derived from aldoses or ketoses containing 5 or 6 carbon atoms. By virtue of their ready accessibility, alkyl (oligo) glucosides derived from glucose are mainly produced on an industrial scale.

The degree of oligomerization x is a mean value which derives from the homolog distribution of mono-, di-, tr- and higher polyglucosides. Alkyl (oligo)glucosides with a degree of oligomerization x of less than 1.7 and, more particularly, between 1.2 and 1.5 are particularly preferred from the applicational point of view. Such products are commercially obtainable, for example, under the name of Plantaren®200 (Henkel KGaA).

In addition to the alkyl (oligo)glycosides, the shaped soap products according to the invention may also contain other synthetic surfactants, for example high-foaming dermatologically compatible anionic surfactants, ampholytic surfactants, betaine surfactants or nonionic surfactants. A particularly preferred soap product according to the invention is characterized in that up to 15% by weight of synthetic, anionic, zwitterionic or ampholytic surfactants are additionally present. Particularly suitable anionic surfactants are, for example, alkyl ether sulfates with the formula $R^2O—(C_2H_4O)_n—SO_3Na$, where $R^2$ is a preferably linear primary alkyl group containing 12 to 16 carbon atoms and n has an average value of 1 to 10. Other suitable anionic surfactants are, for example, acyl isethionates with the formula $R^3CO—OCH_2CH_2—SO_3Na$, where $R^3CO$ is a linear acyl group containing 12 to 18 carbon atoms. The anionic surfactants mentioned are also commercially available.

The shaped soap products according to the invention additionally contain water in a quantity of 5 to 15% by weight. The presence of water, which is attributable to the production process, has a beneficial effect on the performance properties of the soap.

Finally, the shaped soap products according to the invention may contain fragrances and other typical auxiliaries and additives in a quantity of up to 5% by weight. Suitable auxiliaries are, for example, binders and plasticizers. Suitable binders and plasticizers are, for example, glycerol, fatty acid partial glycerides and fatty alcohols containing 12 to 22 carbon atoms. The fatty alcohols may be added, for example, as a secondary product of the alkyl (oligo)glucosides together with the alkyl (oligo)glucosides where the alkyl (oligo)glucosides are used as a crude product containing up to 50% by weight of free fatty alcohol.

Other auxiliaries are, for example, dyes, antimicrobial agents, deodorants, pigments ($TiO_2$), optical brighteners and complexing agents.

The shaped soap products according to the invention may be produced in the usual way for soaps. A base soap with a solids content of 25 to 50% by weight is initially prepared from the fatty acids and sodium hydroxide and concentrated to a solids content of 50 to 70% by weight. The talcum, possibly even free fatty acid, an anionic surfactant and a complexing agent may already be incorporated in this—for example 60%—base soap. The base soap is then further dewatered, for example in a vacuum expansion dryer, at 120° C. to 130° C. During the expansion process, the soap cools spontaneously to temperatures below 60° C. and solidifies. Soap noodles with a solids content of 73 to 85% by weight are obtained.

The base soap is then further processed, i.e. made up into the toilet soap. This is carried out in a soap mixer in which a slurry of the alkyl (oligo)glucoside and the other auxiliaries and additives is mixed into the soap noodles. The base soap noodles and the slurry of alkyl (oligo)glycoside and, for example, fragrances, dyes, pigments and other auxiliaries are intensively mixed in a screw mixer with sieve plates and, finally, the mixture is discharged via an extruder and optionally delivered to a bar press where bar soaps are to be produced.

However, shaped soap products according to the invention may also be present as noodles, needles, granules, extrudates, flakes and in any other form typical of soap products.

Alternatively to the described process, the talcum may also be incorporated in the 73–85% base soap at the making-up stage. In this case, the talcum powder is delivered to the soap mixer together with the slurry of alkyl (oligo) glycoside, fragrances and auxiliaries via suitable metering units, for example weighing belts and vibrating feeders.

The soap products according to the invention are distinguished by a particularly smooth surface which ensures an agreeable appearance, particularly where they are made up into bar soap. In use, a rich, fine and creamy foam is formed. Although lime soap precipitates are also formed in hard water, they remain dispersed in the solution and are not deposited on hard surfaces as greasy grey patches or a cheese-like crust, but at best as a light fine-particle film.

The following Examples are intended to illustrate the invention.

EXAMPLES

Formulations

| | 1 | 2 | 3 | 4 |
|---|---|---|---|---|
| Base soap (1) | 82 | 75 | 87 | 80 |
| Plantacare 2000 UP (2) | 2 | 5.4 | 1.5 | 3 |
| Steasilk 5 AE (3) | 15 | 18 | — | 8 |
| Steasilk 5 FL (4) | — | — | 10 | 8 |
| Perfume | 1 | 1.5 | 1 | 1 |
| Dye | — | 0.1 | 0.5 | — |

(1) Composition of the base soap:
85% by weight Na soaps (of 75% by weight hydr. tallow fatty acid and 25% by weight cocofatty acid)
1% by weight free fatty acid
1% by weight glycerol
13% by weight water
(2) Plantacare ® 2000 UP: $C_{8-16}$ alkyl glucoside (x = 1.2)
(3) Steasilk ® 5 AE talcum powder consisting of
97% by weight magnesium silicate hydrate
1% by weight magnesium aluminium silicate hydrate
2% by weight calcium magnesium carbonate particle size distribution:
5% by weight smaller than 1 μm
5% by weight larger than 40 μm
(4) Steasilk ® 5 FL: talcum powder consisting of
45% by weight magnesium silicate hydrate
54% by weight magnesium aluminium silicate hydrate
1% by weight calcium magnesium carbonate particle size distribution:
5% by weight smaller than 1 μm
5% by weight larger than 30 μm Production The base soap noodles are introduced with the other components into a standard soap mixer (screw mixer with sieve plate), homogenized by repeated mixing, discharged through an extruder, cut and processed to bars in the usual way.

We claim:

1. A shaped soap composition comprising:

(a) 60 to 85 percent by weight of a linear fatty acid containing 12 to 22 carbon atoms, wherein said linear fatty acid is in the form of an alkali metal soap;

(b) 1 to 10 percent by weight of an alkyl glycoside, alkyl oligoglycoside or mixtures thereof having the formula:

$$R^1—O(G)_x$$

wherein $R^1$ is a primary $C_{12-16}$ alkyl group and $(G)_x$ is an oligoglycoside unit with x representing a degree of oligomerization of 1 to 2; and (c) 5 to 20 percent by weight of talcum.

2. The soap composition of claim 1 wherein the linear fatty acid is a technical mixture of fatty acid obtained from vegetable or animal fat or oil.

3. The soap composition of claim 2 wherein the linear fatty acid comprises a mixture of 50 to 80 percent by weight $C_{16-18}$ tallow fatty acid and 20 to 50 percent by weight $C_{12-14}$ cocofatty acid.

4. The soap composition of claim 1 wherein the alkyl oligoglyoside has a degree of oligomerization of 1 to 1.7.

5. The soap composition of claim 4 wherein the alkyl oligoglyoside has a degree of oligomerization of 1.2 to 1.5.

6. The soap composition of claim 1 wherein the talcum has an equivalent spherical diameter of 0.5 to 50 micrometers.

7. The soap composition of claim 1 wherein the talcum has a mean particle diameter of 5 to 15 micrometers.

8. The soap composition of claim 1 further comprising 1 to 10 percent by weight of free fatty acid containing 12 to 22 carbon atoms.

9. The soap composition of claim 1 further comprising 0 to 15 percent by weight of synthetic, anionic, zwitterionic or ampholytic surfactants.

10. The soap composition of claim 1 further comprising 5 to 15 percent by weight of water.

11. The soap composition of claim 1 further comprising 0 to 5 percent by weight auxiliaries and additives.

* * * * *

UNITED STATES PATENT AND TRADEMARK OFFICE

CERTIFICATE OF CORRECTION

PATENT NO. : 6,225,270 B1
DATED : May 1, 2001
INVENTOR(S) : Hennen et al.

It is certified that error appears in the above-identified patent and that said Letters Patent is hereby corrected as shown below:

Title page,
Item [54], Title, delete "OLIGAGLYCASIDES", and insert therefor
-- OLIGOGLYCOSIDES --.

Column 4,
Lines 65 and 67, delete "oligoglyoside", and insert therefor -- oligoglycoside --.

Signed and Sealed this

Sixteenth Day of September, 2003

JAMES E. ROGAN
*Director of the United States Patent and Trademark Office*